US010308015B2

(12) United States Patent
Wagner et al.

(10) Patent No.: US 10,308,015 B2
(45) Date of Patent: Jun. 4, 2019

(54) IDENTIFYING PRIMED PRINTHEADS

(71) Applicant: Hewlett-Packard Development Company, L.P., Houston, TX (US)

(72) Inventors: Jeffrey A Wagner, Vancouver, WA (US); David Welter, Corvallis, OR (US); Eng Gee Jonny Goh, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 111 days.

(21) Appl. No.: 15/521,511

(22) PCT Filed: Jan. 29, 2015

(86) PCT No.: PCT/US2015/013589

§ 371 (c)(1),
(2) Date: Apr. 24, 2017

(87) PCT Pub. No.: WO2016/122543

PCT Pub. Date: Aug. 4, 2016

(65) Prior Publication Data

US 2017/0305149 A1 Oct. 26, 2017

(51) Int. Cl.
*B41J 2/175* (2006.01)
*B41J 2/045* (2006.01)

(52) U.S. Cl.
CPC ..... *B41J 2/04508* (2013.01); *B41J 2/04586* (2013.01); *B41J 2/175* (2013.01); *B41J 2/17596* (2013.01)

(58) Field of Classification Search
CPC ..... B41J 2/175; B41J 2/17596; B41J 2/04508
See application file for complete search history.

(56) References Cited

U.S. PATENT DOCUMENTS

| | | | | |
|---|---|---|---|---|
| 4,910,529 | A | 3/1990 | Regnault | |
| 5,704,403 | A | 1/1998 | Schwenk et al. | |
| 6,454,375 | B2 | 9/2002 | Wilson et al. | |
| 6,698,869 | B2 | 3/2004 | Vosahlo | |
| 7,207,666 | B2 | 4/2007 | Ord et al. | |
| 8,408,685 | B2 | 4/2013 | Delueg | |
| 8,696,080 | B2 | 4/2014 | Cerro et al. | |
| 8,746,860 | B2 | 6/2014 | Delueg | |
| 2005/0030353 | A1 | 2/2005 | Ord et al. | |
| 2013/0044148 | A1 | 2/2013 | Kobayashi | |
| 2013/0135401 | A1 | 5/2013 | Kobayashi et al. | |
| 2014/0063152 | A1* | 3/2014 | Ito | B41J 2/175 347/86 |
| 2014/0292872 | A1 | 10/2014 | Numata | |

FOREIGN PATENT DOCUMENTS

| | | |
|---|---|---|
| CN | 102791490 | 11/2012 |
| CN | 103826858 B | 8/2016 |
| EP | 0635371 | 1/1995 |
| EP | 2165837 | 3/2010 |
| EP | 2708362 | 3/2014 |

* cited by examiner

*Primary Examiner* — Sharon A Polk
(74) *Attorney, Agent, or Firm* — Brooks Cameron & Huebsch PLLC

(57) ABSTRACT

Priming printheads can, in various examples, include moving a movable member of a printhead from a first position to a second position, measuring a response time of the movable member to move from the first position to the second position, and identifying the printhead as primed.

15 Claims, 5 Drawing Sheets

IDENTIFYING PRIMED PRINTHEADS

BACKGROUND

Various printers such as ink-jet printers may employ a printhead with nozzles that apply a quantity of printing fluid from the nozzles to specified pixel locations on a print medium. Such printheads may be coupled to a printing fluid supply that is primed (e.g., pressurized) in advance of printing to apply a quantity of printing fluid as intended (i.e., print as intended).

DETAILED DESCRIPTION

Figure 1:
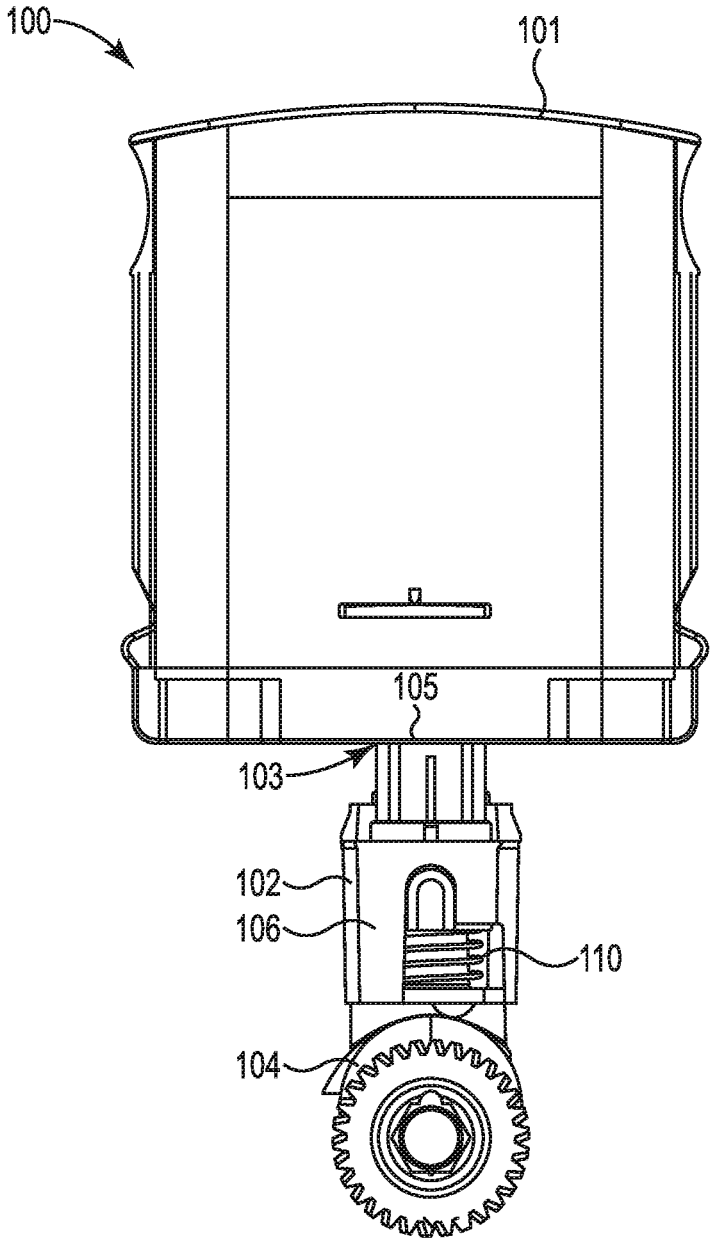
FIG. 1 illustrates a diagram of a portion of an example of a system to identify primed printheads according to the present disclosure.

With increasing pressure on organizations to improve their performance, the organizations may seek to increase efficiencies of services and/or products provided, for instance, by pursuing improved performance (e.g., comparatively increased print quality and/or printing speed) of printers. Various printers such as ink-jet printers and/or three dimensional printers (e.g., three dimensional printers utilizing various ink-jet components) may employ a printhead with nozzles that apply a quantity of printing fluid from the nozzles to specified pixel locations on a print medium. That is, each of the nozzles may be controlled to produce a desired pixel pattern on the print medium. However, producing the desired pixel pattern may be predicated on a printing fluid supply (i.e., an ink supply) coupled to and/or in fluidic communication with the printhead being primed (e.g., in a state ready to provide an amount of printing fluid sufficient to obtain the desired pixel pattern). Put another way, when such an ink supply is not primed in advance of printing, various difficulties including not providing a desired amount of printing fluid to the printhead may occur.

Some approaches employ a gas (e.g., air) pump to prime a printhead. In such approaches, the gas pump changes an internal pressure of the printhead. For example, gas pressure pulses from a pressure source or pressure sources (e.g., such as blow-priming pumps) may serve as priming events that force a small volume of gas into regulator gas bags inside a printing fluid pen (i.e., an inkjet pen). As the gas pressure pulses inflate the regulator gas bags, a small volume is displaced within the regulator chamber (printing fluid reservoir) of an inkjet pen. Priming may occur with or without ejecting or forcing printing fluid out of the printhead. Often a printer controller (i.e., a controller) controls pulse lengths, dwell times and a number of gas pulses from the pressure source(s) based on operating characteristics of the inkjet pen, such as the printing fluid rheology, operating temperature, and micro-fluidic architecture of the particular printhead.

The gas pump may be operated (run to provide gas to the printhead) based on a predetermined criterion and/or based on a measurement from a pressure sensor. Examples of predetermined criteria include a predetermined number of cycles of the pump and/or a predetermined amount of time operating the pump, among other predetermined criteria, in an effort to prime a pump. However, operation of a pump based on a predetermined criterion may be ineffective (e.g., may not prime the pump), inefficient, and/or costly, among other difficulties. For instance, operation of a pump a predetermined number of cycles (e.g., 40 cycles) may unnecessarily operate the pump and/or delay printing when the printhead is primed in less than the predetermined number of cycles (e.g., 25 cycles).

A pressure sensor may measure an actual pressure and/or determine based on the measured actual pressure when the printhead is primed. The pressure sensor may be located along a printing fluid flow path (i.e., ink flow path) provided by fluid passages from an ink supply to the printhead and/or located in the printhead. However, such approaches may be costly (e.g., take up valuable space on or around a printhead), ineffective (e.g., subject to fouling by corrosive printing fluid, etc.), among other difficulties.

In contrast, examples of the present disclosure include methods, systems, and computer-readable media with executable instructions stored thereon to identify primed printheads. Identifying primed printheads can, for example, include moving a movable member of a printhead from a first position to a second position (e.g., to cause ink to flow from an ink supply into the printhead to prime the printhead), measuring a response time of the movable member to move from the first position to the second position, and identifying the printhead as primed (e.g., when the measured response time satisfies a threshold time). The measured response time can facilitate estimation of a pressure (e.g., estimation of a pressure along an ink flow path). Such response time measurement (e.g., response time measurement and pressure estimation based on the measured response time) can promote identifying primed printheads. Desirably, identifying primed printheads, as described herein, can realize efficient printhead priming (e.g., moving the moveable member no more or less than is utilized to prime a printhead) and/or allow for flexible printhead priming (e.g., varying a number of times the moveable member is moved from a first position to a second position) to account for real-world variations in printheads and/or printhead priming.

FIG. 1 illustrates a diagram of an example of a system to identify primed printheads 100 according to the present disclosure. As illustrated in FIG. 1, the system to identify primed printheads 100 can include an ink supply 101, a pressurization system 102, a movable member 103, a drive mechanism 104, flexible diaphragm 105 (i.e., a bongo), a base member 106, and a spring 110, among other components. Examples of ink supplies, pressurization systems, movable members, drive mechanisms, flexible diaphragms, base members, and springs 110 (i.e., compression springs), among other components such as employed in off-axis printers are shown and described in U.S. Pat. No. 7,207,666 entitled "printer ink supply system" the full disclosure of which is hereby incorporated by reference. In various examples, the ink supply 101 is located off-axis and provides liquid printing fluid to the printheads through fluid passages (e.g., flexible tubing) extending between the ink supply and the printhead(s).

The system to identify primed printheads 100 provides a structure for supporting and at least partially housing ink supply 101 and for delivering printing fluid from ink supply 100 (e.g., from multiple ink supplies) to printhead pens (not shown). The ink supply 101 includes a flexible diaphragm 105 by which printing fluid (e.g., ink) contained within an ink flow path provided by a fluid passage is pressurized. The ink supply 101 is fluidly coupled to printhead pens. As used herein, "fluidly coupled" or "in fluid communication" means that two or more members having fluid containing volumes are connected to one another by one or more fluid passages enabling fluid to flow between the volumes in one or both directions. Such fluid flow may be temporarily ceased by selective actuation of valve devices (e.g., a check valve). Ink supply 101 includes an ink or other fluid reservoir, a fluid passage extending from the reservoir to a printhead, and a flexible diaphragm 105. Movement of flexible diaphragm 105 and/or the moveable member 103 pressurizes printing fluid along passage to move the printing fluid through fluid passage to the printhead pen(s).

Fluid passage may be temporarily occluded at points between the reservoir and printhead pens during the supply of printing fluid to printhead pens. For example, the fluid passage can be temporarily occluded and/or pressurized by movement of the movable member 103 from a first position to a second position. As described herein, a time associated with the first position and a time associated with the second position of the movable member 103 can be recorded to promote measuring a response time of the movable member and/or to promote identifying primed printheads. A response time refers to a difference between the time associated with the first position and a time associated with the second position. Put another way, the response time can be equal to an amount of time it takes the movable member 103 to move from the first position to the second position.

Notably, response time(s) of successive movements of the moveable member 103 can vary. Such variations are due at least in part to introduction of ink or other printing fluid into a printhead during the course of priming the printhead. For example, as ink or other printing fluid is introduced into the printhead and accumulates therein a pressure inside the printhead and/or along an ink flow path to the printhead increases. This increase in pressure can be correlated to an increase in response time. Put another way, as the pressure in the printhead and/or ink passage increases as printing fluid accumulates a response time of the moveable member 103 increases. In turn, a pressure in the printhead and/or the ink passage can be estimated, as described herein, based on a measured response time of the moveable member 103.

Figure 2:
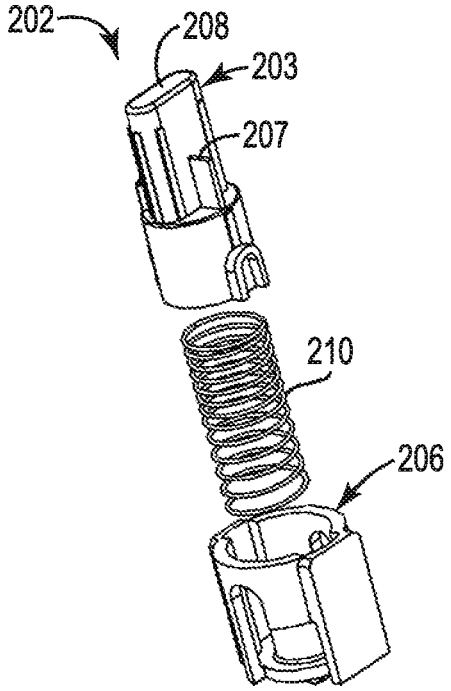
FIG. 2 illustrates a diagram of a portion of an example of a system to identify primed printheads according to the present disclosure.
Figure 3:
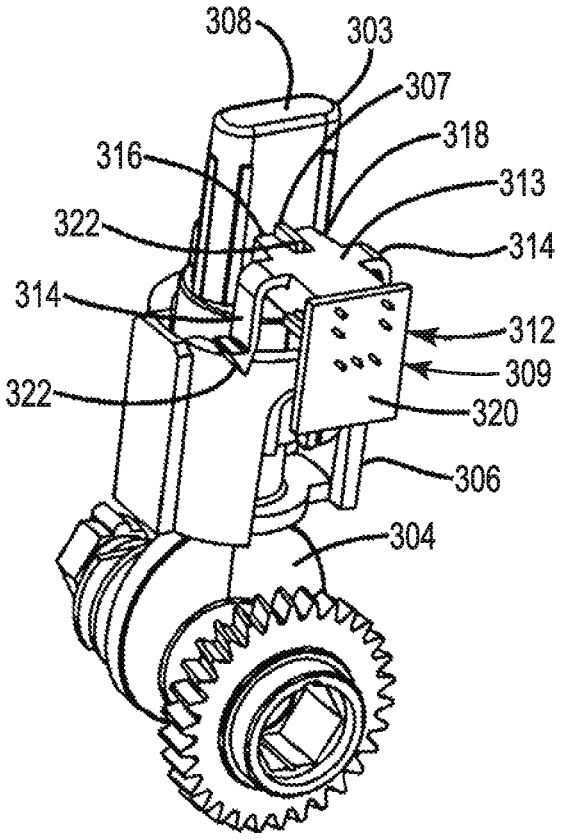
FIG. 3 illustrates a diagram of a portion of an example of a system to identify primed printheads according to the present disclosure.
Figure 4:
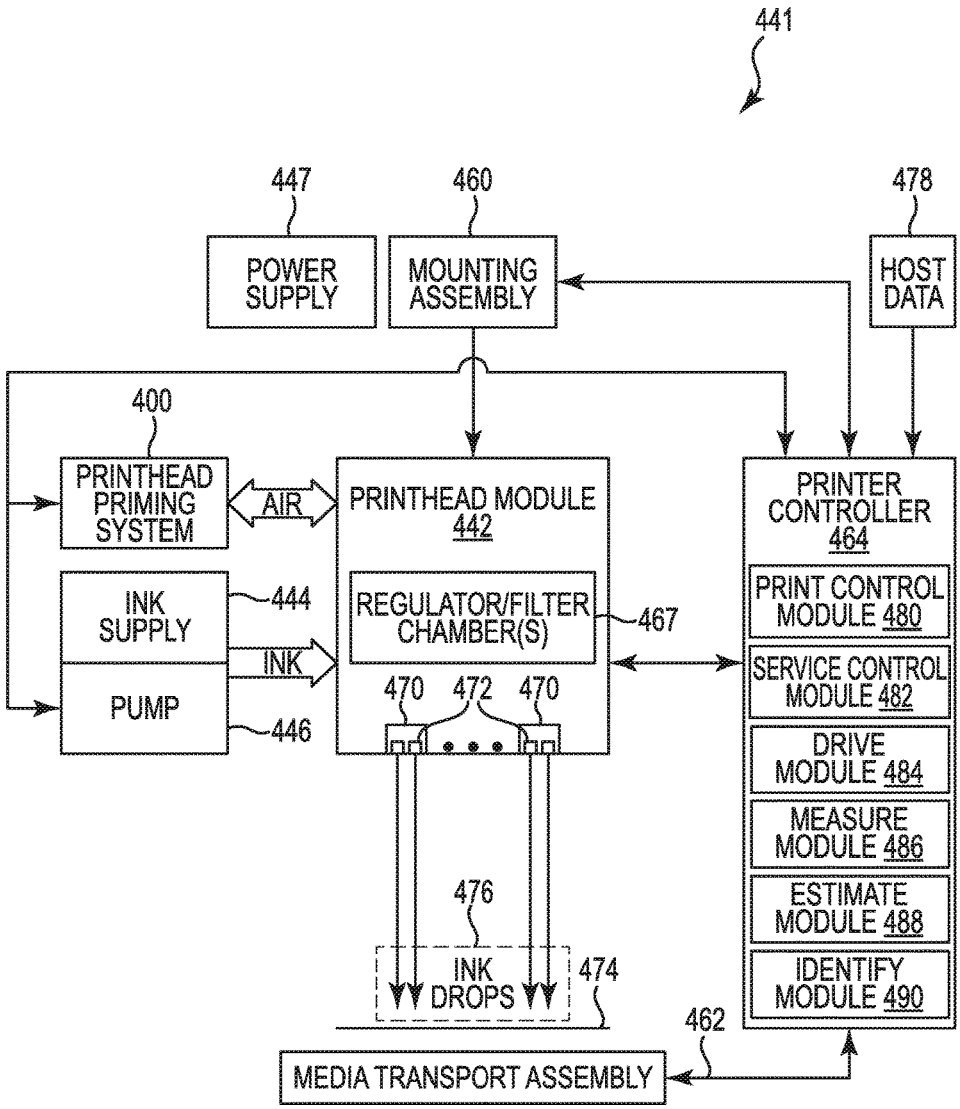
FIG. 4 illustrates a diagram of an example of a printer with an example of a system to identify primed printheads according to the present disclosure.

Additionally, while FIG. 1, and similarly FIGS. 2, 3, and 4, as described herein, illustrates a particular number of each of the illustrated components the present disclosure is not so limited. Rather, more or less components can be included, for instance in system to identify primed printheads 100, to promote identifying primed printheads as described herein. For instance, in one or more examples, each ink supply of a plurality of ink supplies has an individual (i.e., respective) fluid passage connected to a dedicated pen. In such an example, each ink supply can have a respective pressurization system 102, a movable member 103, a drive mechanism 104, a flexible diaphragm 105, a base member 106, and/or a spring 110, among other components associated therewith.

The pressurization system 102 includes the movable member 103, the base member 106 and the spring 110. In various examples, spring 110 can be coupled to the base member 106 and the moveable member 103. The pressurization system 102 is operably coupled between the drive mechanism 104 and the flexible diaphragm 105 of the ink supply 101. Pressurization system 102 is slidably disposed within an interior cavity formed in chassis (not shown).

Pressurization system 102 includes the movable member that can move while in engagement with the flexible diaphragm 105 to move the flexible diaphragm 105. The movable member 103 is movable from a first position to a second position to cause printing fluid to flow from the ink supply 101 along an ink flow path into the printhead to prime the printhead. The first position refers to a position associated with (abutting or engaging) the base member. That is, at the first position, the movable member 103 is not engaging or abutting the ink supply 101. For instance, in one or more examples, the first position can be a position of moveable member 103 that allows the movable member to interface directly or indirectly via the base member with the drive mechanism 104.

The second position refers to a position of moveable member 103 associated with (abutting or engaging) the ink supply 101 (e.g., engaging the flexible diaphragm 105 of the ink supply 101). Put another way, the movable member 103 can engage a reservoir (containing ink or other printing fluid) of the ink supply 101 at the second position to cause printing fluid to flow from the ink supply 101 into the ink flow path and/or into the printhead.

A time associated with the first position can coincide with a time of actuation of the drive mechanism and/or a time at which the drive mechanism 104 imparts (directly or indirectly) a force to the moveable member 103. As time associated with the second position can coincide with a time at which the moveable member is associated with (engages or abuts) the ink supply 101. For example, a time associated with the second position can be equal to a time associated with triggering a flag, as described herein, being triggered by movement of the movable member (e.g., in response to the moveable member 103 moving to the second position). That is, a time associated with the second position can be recorded upon triggering (e.g, initially triggering) the flag.

The drive mechanism 104, in various examples, can apply a force to the base member 106 to move the movable member 103 so as to move the flexible diaphragm 105 and/or move the movable member 103 from a first position associated with the base member to a second position associated with the flexible diaphragm 105. In some examples, the drive mechanism includes a cam and/or a piston, among other suitable components. In various examples, such as those in which the drive mechanism includes a cam, the drive mechanism 104 can rotated so as to move the pressurization system 102 and the movable member 103 against the flexible diaphragm 105 of ink supply 101. In some examples, supply of pressurized gas or fluid against the drive mechanism 104 can moves the movable member 103 while the movable member is in engagement with the flexible diaphragm 105.

FIG. 2 illustrates a diagram of a portion of an example of a system to identify primed printheads according to the present disclosure. More specifically, FIG. 2 illustrates an exploded view of an example of a pressurization system 202 that may be analogous or similar to pressurization system 102 illustrated in FIG. 1. Pressurization system 202 includes a movable member 203, a base member 206 and a spring 210, among other components.

Movable member 203 (i.e., a lifter) includes a hub, an extension, flag 207 and projections 211. The hub includes a hollow interior to receive an upper end of the spring 210. The hub is slidably received within base member 206. The extension extends from hub and is to pass through an opening of a chassis. The extension includes an engagement surface 208 which bears against a lower surface of the flexible diaphragm of an ink supply. The flag 207 projects from the extension and is to cooperate with a sensor, as described herein, to facilitate the detection of movement of the movable member 203. The projections project outwardly from the hub and interact with the base member 206 to releasably secure the movable member 203 to the base member 206.

FIG. 3 illustrates a diagram of a portion of an example of a system to identify primed printheads according to the present disclosure. As illustrated in FIG. 3, the sensor 309 includes a body 313, a sensing mechanism 312 and prongs 314. The body 313 includes a housing located about a sensing mechanism 312. The sensing mechanism 312 senses movement of the movable member 303. That is, in one or examples, including the example illustrated in FIG. 3, the sensing mechanism 312 comprises a photo or optical detector including a light emitter 316, a light receiver or detector 318 (schematically shown) and a printed circuit assembly 320. The light emitter 316 and the light receiver 318 are spaced from one another on opposite sides of an opening 322 formed within the housing 313. The opening 322 receives flag 307 of movable member 303. Flag 307 interrupts the light passing from emitter 316 to receiver 318 when the movable member 303 is in the second position, as described herein. As a result, detector mechanism 312 senses movement of movable member 303 and senses the moveable member at a position (e.g., at the second position when priming a printhead). A wiring harness (not shown) is connected to each of printed circuit assemblies 320 of sensors 309 and is further connected to a printer controller, as described herein.

FIG. 4 illustrates a diagram of an example of a printer with an example of a system to identify primed printheads according to the present disclosure. Printer 441 includes an inkjet pen or printhead module 442 (the terms "inkjet pen" and "printhead module" may be used interchangeably throughout this disclosure), an ink supply 444, a pump 446, a printhead priming system 400, mounting assembly 460, a media transport assembly 472, a printer controller 464, and at least one power supply 447 that provides power to the various electrical components of printer 441. Printhead module includes one or more regulator/filter chambers 467 that contain pressure control regulators to regulate printing fluid pressure within the chambers 467 and one or more filters to filter printing fluid. Printhead module 442 also includes at least one fluid ejection assembly or printhead 470 (e.g., a thermal or piezoelectric printhead) having a printhead die and associated mechanical and electrical components for ejecting drops of printing fluid through a plurality of orifices or printing fluid ejection nozzles (i.e., ink ejection nozzles 472) toward print media 474 so as to print onto print media 474. Printhead module 442 includes a carrier that carries the printhead 470, provides electrical communication between the printhead 470 and printer controller 464, and provides fluidic communication between the printhead 470 and ink supply 444 through carrier manifold passages.

Nozzles 472 are usually arranged in one or more columns such that properly sequenced ejection of printing fluid from the nozzles causes characters, symbols, and/or other graphics or images to be printed upon print media 474 as the printhead module 442 and print media 474 are moved relative to each other. A typical thermal inkjet (TIJ) printhead includes a nozzle layer arrayed with nozzles 472 and firing resistors formed on an integrated circuit chip/die positioned behind the nozzles. Each printhead 470 is operatively connected to printer controller 464 and ink supply 444. In operation, printer controller 464 selectively energizes the firing resistors to generate heat and vaporize small portions of fluid within firing chambers, forming vapor bubbles that eject drops of printing fluid through nozzles 472 on to the print media 474. In a piezoelectric (PIJ) printhead, a piezoelectric element is used to eject printing fluid from a nozzle. In operation, printer controller 464 selectively energizes the piezoelectric elements located close to the nozzles, causing them to deform very rapidly and eject printing fluid through the nozzles.

Ink supply 444 and pump 446 form part of an ink delivery system (IDS) within printer 441. In general, the IDS causes printing fluid to flow to printheads 470 from ink supply 444 through chambers 467 in printhead module 442. In some examples the IDS may also include a vacuum pump (not shown) that together with the ink supply 444, pump 446 and printhead modules 442, form an ink recirculation system between the supply 444 and printhead module 442. In a recirculating system having a vacuum pump, portions of printing fluid not consumed (i.e., printing fluid not ejected) can flow back again to the ink supply 444. In one or more examples of a recirculating system, a single pump such as pump 446 can be used to both supply and recirculate printing fluid in the IDS such that a vacuum pump may not be included.

As illustrated in FIG. 4, the system to identify primed printheads 400 is included in the printer 441. The system to identify primed printheads 400 (i.e., printhead priming system) can include an ink supply (e.g., ink supply 444 included in the printer 441 and/or an ink supply coupled to the printer 441), a fluid passage, a moveable member, a sensor (e.g., an optical sensor), a flexible diaphragm, however, the system to identify primed printheads 400 can include more or less components suitable to promote identifying primed printheads, as described herein. For instance, while printer controller 464 is illustrated as separate from the system to identify primed printhead 400, in various examples, printer controller 464 can be included in the system to identify primed printheads 400.

In various examples, the system to identify primed printheads 400 and the printer 441 do not include a pressure sensor. That is, identifying primed printheads, as described herein, can desirably realize efficient printhead priming (e.g., moving the moveable member no more or less than is utilized to prime a printhead) and/or allow for flexible printhead priming (e.g., varying a number of times the moveable member is moved from a first position to a second position when priming a printhead) to account for real-world variations in printhead priming without space intensive and/or expensive components such as pressure sensors.

Mounting assembly 460 positions printhead module 442 relative to media transport assembly 472, and media transport assembly 472 positions print media 474 relative to inkjet printhead module 442. Thus, a print zone 476 is defined adjacent to nozzles 472 in an area between printhead module 442 and print media 474. Printer 441 may include a series of printhead modules 442 that are stationary and that span the width of the print media 474, or one or more modules that scan back and forth across the width of print media 474. In a scanning type printhead assembly, mounting assembly 460 includes a moveable carriage for moving printhead module(s) 442 relative to media transport assembly 472 to scan print media 474. In a stationary or nonscanning type printhead assembly, mounting assembly 460 fixes printhead module(s) 442 at a prescribed position relative to media transport assembly 472. Thus, media transport assembly 472 positions print media 474 relative to printhead module(s) 442.

Data 478 can be sent to printer 441 along an electronic, infrared, optical, or other information transfer path. Data 478 represents, for example, a document and/or file to be printed. As such, data 478 forms a print job for printer 441 and includes one or more print job commands and/or command parameters. Printer controller 464 receives host data 478 from a host system, such as a computer, and includes memory for temporarily or otherwise storing data 478.

Printer controller 464 typically includes a processor, software, hardware, firmware, and/or logic, and other printer electronics to perform a number of functions described herein including communicating with and controlling inkjet printhead module 442, a printhead priming system 400, ink supply 444 and pump 446, mounting assembly 460, and media transport assembly 472. For example, the printer controller 464 can be a combination of hardware and instructions to prime printheads. The hardware, for example can include a processing resource and/or a memory resource (e.g., computer-readable medium (CRM), data store, etc.)

A processing resource, as used herein, can include a number of processors capable of executing instructions stored by a memory resource. Processing resource can be integrated in a single device or distributed across multiple devices (e.g., multiple servers). The instructions (e.g., computer-readable instructions (CRI)) can include instructions stored on the memory resource and executable by the processing resource to implement a desired function (e.g., supplying pressurized gas to an inlet of a conduit from a pressure source, etc.).

The memory resource can be in communication with a processing resource. A memory resource, as used herein, can include a number of memory components capable of storing instructions that can be executed by processing resource. Such memory resource can be a non-transitory CRM. Memory resource can be integrated in a single device or distributed across multiple devices. Further, memory resource can be fully or partially integrated in the same device as processing resource or it can be separate but accessible to that device and processing resource. Thus, it is noted that the print controller 464 can be implemented as part of or in conjunction with the systems and printers, as described herein.

The memory resource can be in communication with the processing resource via a communication link (e.g., path). The communication link can be local or remote to a computing device associated with the processing resource. Examples of a local communication link can include an electronic bus internal to a computing device where the memory resource is one of volatile, non-volatile, fixed, and/or removable storage medium in communication with the processing resource via the electronic bus.

The memory resource and therefore the printer controller 464 include a number of modules such as a print control module 480, a service control module 482, a drive module 484, a measure module 486, an estimate module 488, an identify module 490, etc. The number of modules 480, 482, 484, 486, 488, 490 can include CRI that when executed by the processing resource can perform a number of functions. The number of modules 480, 482, 484, 486, 488, 490 can be sub-modules of other modules. For example, the print control module 480 and the service control module 482 can be sub-modules and/or contained within the same computing device. In another example, the number of modules 480, 482, 484, 486, 488, 490 can comprise individual modules at separate and distinct locations (e.g., CRM, etc.).

Each of the number of modules 480, 482, 484, 486, 488, 490 can include instructions that when executed by the processing resource can perform various functions including those described herein. For example, the print control module 480 includes instructions that when executed by the processing resource control inkjet printhead module 442 and printheads 470 to eject printing fluid drops from nozzles 472. Thus, printer controller 464 defines a pattern of ejected printing fluid drops which form characters, symbols, and/or other graphics or images on print media 474. The pattern of ejected printing fluid drops is determined by the print job commands and/or command parameters from data 478.

The print control module 480 includes instructions that when executed by the processing resource control servicing of printhead module 442, for example, by controlling nozzle priming events through the operation of a printhead priming system 400 including pressure source(s). More specifically, print controller 464 executes instructions from service control module 482 to control which pressure sources are generating gas (e.g., air) pressure pulses (i.e., when there are multiple pressure sources), the timing of the pulses (e.g., with respect to printing drop ejection events), the pulse lengths, the dwell times (i.e., the time between each gas pressure pulse needed to deflate the regulator gas bag) and the number of pulses being generated and directed through pressure regulator vents into regulator gas bags or dedicated printing fluid priming ports within printhead module 442.

Service control module 482 instructions can be specifically configured based on operating characteristics of the particular printhead module 442 in order to control the pulse lengths, dwell times and number of gas pulses in a manner that achieves printing fluid displacements within the printhead module 442 that cause disruptions of the printing fluid meniscus in nozzles without causing printing fluid to be ejected from or drool from the nozzles. Such characteristics can include, for example, rheology of the printing fluid being used in printhead module 442, the operating temperature, and micro-fluidic architecture of the particular printhead 470.

Drive module 484 includes instructions that when executed by the processing resource can actuate a drive mechanism to cyclically move a movable member of a printhead from a first position to a second position, as described herein. Again, such movement of the moveable member can cause a flow of printing fluid from an ink supply to the printhead. In some examples, the instructions can include instructions to continue to cyclically move the movable member of a printhead from the first position to the second position when the estimated pressure does not satisfy the threshold pressure. In this manner, actuation of the moveable member can continue until a measured pressure, such as those measured by measure module 486 described herein, satisfies the threshold pressure (i.e., the printer is primed). In various examples, the instructions can include instructions to print at least a portion (e.g., a page) of a print job in response to the identification of the printhead as primed.

In one or more examples, the instructions can include instructions to initiate a recovery routine when the estimated pressure does not satisfy the threshold pressure. A recovery routine refers to an action(s) automatically conducted by the printer and/or related components in an effort to prepare the printer to be primed. Examples of a recovery routine include resetting the printer (e.g., cycling on/off power to the printer)

and/or conducting various operations using the printer controller (e.g., reinitiating a priming sequence to prime the printhead), among other possibilities.

Measure module 486 includes instructions that when executed by the processing resource measure respective response times of the movable member to move from the first position to the second position. Measure module 486 can store measured response times and/or communicate measured response times to a component with an expectation that the component will store the response times.

Estimate module 488 includes instructions that when executed by the processing resource estimate an ink supply pressure for each of the respective response times. That is, each measured response time has a corresponding pressure. The relationship between measured response times and corresponding estimated ink supply pressures can be predetermined (e.g., stored in memory) and/or determined in response to measuring a response time utilizing various techniques to promote identifying primed printheads, as described herein. That is, a particular measured response time (1004 milliseconds) and/or an approximation of the particular measured response time (e.g., 1000 milliseconds) can be associated with a predetermined estimated pressure of an ink supply. For example, a measured response time (1004 milliseconds) can have a predetermined estimated pressure of an ink supply associated with the measured response time. Identify module 490 includes instructions that when executed by the processing resource identify the printhead as primed when an estimated pressure along the ink flow path satisfies (is equal to and/or greater than) a threshold pressure.

In one or more examples, printer 441 is a drop-on-demand thermal bubble printer where the printhead 470 is a thermal inkjet (TIJ) printhead. The TIJ printhead implements a thermal resistor ejection element in a printing fluid chamber to vaporize ink and create bubbles that force ink or other fluid drops out of a nozzle 472. In another example, printer 441 is a drop-on-demand piezoelectric printer where the printhead 470 is a piezoelectric inkjet (PIJ) printhead that implements a piezoelectric material actuator as an ejection element to generate pressure pulses that force ink drops out of a nozzle 472.

Figure 5:
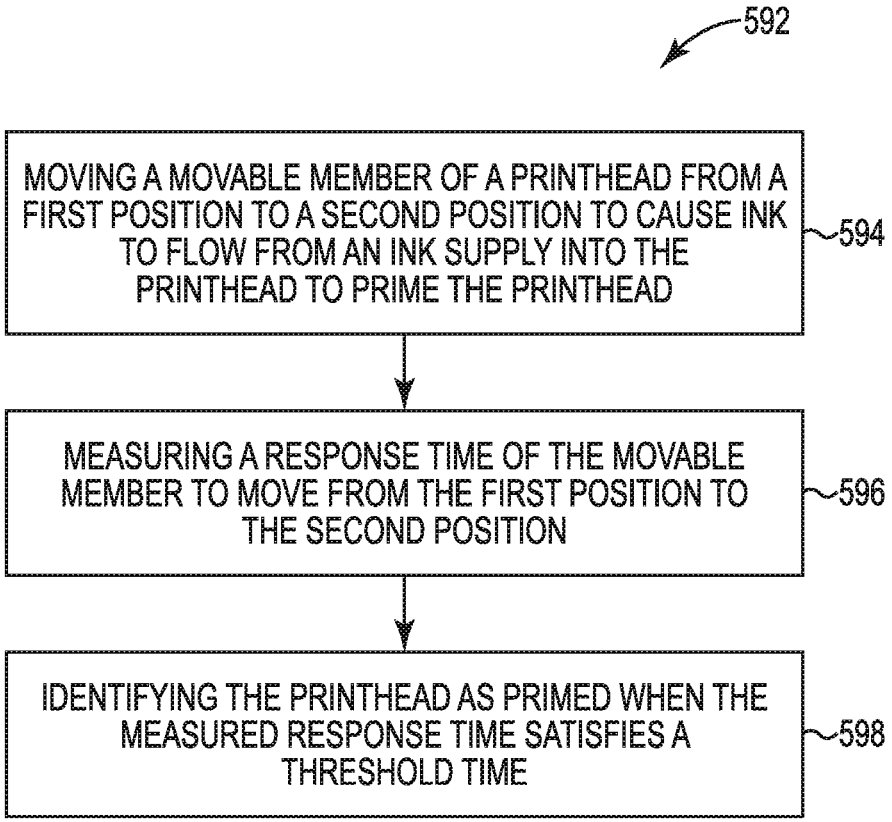
FIG. 5 illustrates a flow diagram of an example of a method to identify primed printheads according to the present disclosure.

FIG. 5 illustrates a flow diagram of an example of a method to identify primed printheads according to the present disclosure. As shown at 594, in various examples, the method 592 can include moving a movable member of a printhead from a first position to a second position to cause ink to flow from an ink supply (e.g., along an ink flow path) into the printhead to prime the printhead, as described herein. Moving refers to executing instructions to actuate a drive mechanism such as those described herein. The method 592 can include cyclically moving the movable member from the first position to the second position to cause the ink to flow into the printhead to prime the printhead. In one or more examples, the method can include moving the movable member to engage a reservoir of the ink supply at the second position.

The method 592 can include measuring a response time of the movable member to move from the first position to the second position, as shown at 596. Measuring refers to ascertaining and/or storing a time and/or amount of time elapsed between time different times. For instance, in various examples, a measured response time is equal to a difference between a first time associated with the movable member being at the first position and a second time associated with the movable member being at the second position. The first time can be recorded upon actuation of a drive mechanism, as described herein. The second time can be recorded upon sensing the movable member at the second position.

As shown at 598, the method 592 can include identifying the printhead as primed when the measured response time such as those measured at 596 satisfies a threshold time, as described herein. Identifying refers to establishing and/or indicating the printhead as primed. In one or more examples, a measured response time can be identified as satisfying a threshold time when the measured response time (e.g., 1200 milliseconds) is equal to or greater than the threshold time (e.g., 1100 milliseconds).

In some examples, the method 592 can include sensing movement of the movable member relative to a flexible diaphragm with an optical sensing mechanism of a sensor. For instance, the moveable member can be sensed by the sensor (e.g., an optical sensor) at the second position, as the moveable member moves towards and/or away from the second position, and/or at a position other than the second position (e.g., sensing no moveable member at the second position), among other possibilities. For example, the method can include sensing via an optical sensor (e.g., an additional optical sensor) the presence of the moveable member at the first position.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. For example, reference numeral 102 may refer to element "00" in FIG. 1 and an analogous element may be identified by reference numeral 202 in FIG. 2. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. Further, as used herein, "a number of" an element and/or feature can refer to one or more of such elements and/or features.

As used herein, "logic" is an alternative or additional processing resource to perform a particular action and/or function, etc., described herein, which includes hardware, e.g., various forms of transistor logic, application specific integrated circuits (ASICs), etc., as opposed to computer executable instructions, e.g., software firmware, etc., stored in memory and executable by a processor.

It will be understood that when an element is referred to as being "on," "connected to" or "coupled with" another element, it can be directly on, connected, or coupled with the other element or intervening elements may be present. In contrast, when an element is referred to as being "directly on," "directly connected to" or "directly coupled with" another element, there are no intervening elements or layers present.

As used herein, the term "and/or" includes any and all combinations of a number of the associated listed items. As used herein the term "or," unless otherwise noted, means logically inclusive or. That is, "A or B" can include (A), (B), or (both A and B). In other words, "A or B" can mean "A and/or B" or "one or more of A and B."

What is claimed:

1. A method, comprising:

moving a movable member of a printhead from a first position to a second position to cause ink to flow from an ink supply into the printhead to prime the printhead;

measuring a response time of the movable member to move from the first position to the second position; and identifying the printhead as primed when the measured response time satisfies a threshold time.

2. The method of claim 1, including sensing movement of the movable member relative to a flexible diaphragm with an optical sensing mechanism of a sensor.

3. The method of claim 1, including moving the movable member to engage a reservoir of the ink supply at the second position.

4. The method of claim 1, where the measured response time is equal to a difference between a first time associated with the first position and a second time associated with the second position.

5. The method of claim 4, where the first time is recorded upon actuation of a drive mechanism and the second time is recorded upon sensing the movable member at the second position.

6. The method of claim 1, including cyclically moving the movable member from the first position to the second position to cause the ink to flow into the printhead to prime the printhead.

7. The method of claim 1, where the measured response time satisfying the threshold time is equal to or greater than the threshold time.

8. A non-transitory computer readable medium storing instructions executable by a processing resource to cause a computer to, comprising actuate a drive mechanism to cyclically move a movable member of a printhead from a first position to a second position;

measure respective response times of the movable member to move from the first position to the second position;

estimate an ink supply pressure for each of the respective response times; and identify the printhead as primed when an estimated pressure satisfies a threshold pressure.

9. The non-transitory computer readable medium of claim 8, including instructions to print at least a portion of a print job in response to identification of the printhead as primed.

10. The non-transitory computer readable medium 8, including instructions to continue to cyclically move the movable member of a printhead from the first position to the second position when the estimated pressure does not satisfy the threshold pressure.

11. The non-transitory computer readable medium of claim 8, including instructions to initiate a recovery routine when the estimated pressure does not satisfy the threshold pressure.

12. A printing system comprising:

an ink supply including a flexible diaphragm;

a pressurization system including:

a movable member;

a base member; and a spring coupled to the base member and the movable member;

a drive mechanism to cyclically move the movable member from a first position associated with the base member to a second position associated with the flexible diaphragm;

a sensor to sense the movable member at the second position; and a controller to identify a printhead as primed when a measured response time of the moveable member satisfies a threshold time.

13. The system of claim 12, where the sensor includes:

a light receiver; and a light emitter spaced from the light receiver to direct light at the light receiver.

14. The system of claim 12, where the ink supply is located off-axis.

15. The system of claim 12, wherein the drive mechanism includes a cam.

* * * * *